US008661568B1

(12) United States Patent
O'Brien

(10) Patent No.: US 8,661,568 B1
(45) Date of Patent: Mar. 4, 2014

(54) HYBRID HOSIERY

(75) Inventor: Kerry K. O'Brien, Shelburne, VT (US)

(73) Assignee: Commando, LLC, South Burlington, VT (US)

( * ) Notice: Subject to any disclaimer, the term of this patent is extended or adjusted under 35 U.S.C. 154(b) by 274 days.

(21) Appl. No.: 12/845,320

(22) Filed: Jul. 28, 2010

Related U.S. Application Data

(60) Provisional application No. 61/229,594, filed on Jul. 29, 2009.

(51) Int. Cl.
*A41B 9/04* (2006.01)

(52) U.S. Cl.
USPC ..... 2/239; 2/409

(58) Field of Classification Search
USPC ..... 2/409, 407, 239, 241, 242, 400, 401, 2/406; 66/104, 171, 172 R, 178 R, 169 R, 66/178 A; 450/104
See application file for complete search history.

(56) References Cited

U.S. PATENT DOCUMENTS 1,128,702 A * 2/1915 McEwan ..... 2/409
1,562,294 A * 11/1925 Cooper ..... 602/25
1,894,891 A * 1/1933 Sachsenmaier ..... 2/239
2,059,097 A * 10/1936 Goodman ..... 2/240
2,224,029 A * 12/1940 Berger ..... 66/178 R
2,325,977 A * 8/1943 Pickles et al. ..... 2/239
2,763,009 A * 9/1956 Blatt ..... 450/104
2,826,760 A * 3/1958 Rice ..... 2/409
2,968,937 A * 1/1961 Margulies ..... 66/187
RE25,360 E * 3/1963 Rice ..... 2/409
3,177,875 A * 4/1965 Garson ..... 450/116
3,342,044 A * 9/1967 Corey ..... 66/169 R
3,466,667 A * 9/1969 Rosner ..... 2/240
3,535,891 A * 10/1970 Corey ..... 66/1 A
3,595,034 A * 7/1971 Safrit ..... 66/27
3,599,241 A * 8/1971 Rossler ..... 2/409
3,678,515 A * 7/1972 Wehrmann ..... 2/409
3,845,506 A * 11/1974 Harris ..... 2/409
3,885,509 A * 5/1975 Cox ..... 112/441
3,916,808 A * 11/1975 Cassinelli ..... 112/63
4,021,861 A * 5/1977 Imboden et al. ..... 2/409
4,244,199 A * 1/1981 Rhode ..... 66/193
4,351,068 A * 9/1982 Taylor ..... 2/409
4,506,392 A * 3/1985 White ..... 2/239
4,794,939 A * 1/1989 Okuda ..... 135/33.2
5,280,652 A * 1/1994 Davis et al. ..... 2/409
5,708,987 A * 1/1998 Matthews ..... 2/409
6,151,927 A * 11/2000 Owens et al. ..... 66/178 R
6,276,175 B1 * 8/2001 Browder, Jr. ..... 66/171
6,457,185 B1 * 10/2002 Frazier ..... 2/239
6,704,942 B2 * 3/2004 Lazarian ..... 2/409

(Continued)

*Primary Examiner* — Richale Quinn
(74) *Attorney, Agent, or Firm* — Downs Rachlin Martin PLLC

(57) ABSTRACT

Hosiery that includes a legwear portion and a waistband secured to the legwear portion. The waistband is made of an elastic material having an unfinished upper edge. The waistband also has an unfinished lower edge that is secured to the legwear portion at a seam that allows the hosiery to lay substantially flat against a wearer's body. The unfinished upper edge of the waistband can provide the wearer with greater comfort relative to conventional hosiery having finished upper edges, which often results in visible and uncomfortable restriction. This hybrid construction also allows the waistband to have varying width around its circumference to compensate for shortcomings of a legwear portion made using conventional tube-construction techniques and/or, when the waistband has a lower stretchability than the legwear portion, to compensate for this lower stretchability.

11 Claims, 2 Drawing Sheets

(56) References Cited

U.S. PATENT DOCUMENTS

| | | | | |
|---|---|---|---|---|
| 7,048,013 | B2 * | 5/2006 | Shannon | 139/422 |
| 7,051,556 | B2 * | 5/2006 | Oya et al. | 66/172 E |
| 7,159,621 | B2 * | 1/2007 | Shannon | 139/422 |
| 7,228,809 | B2 * | 6/2007 | Angelino et al. | 112/475.08 |
| 7,631,521 | B2 * | 12/2009 | Oya | 66/172 E |
| 2006/0101863 | A1 * | 5/2006 | Oya et al. | 66/202 |
| 2007/0199134 | A1 * | 8/2007 | Duckman et al. | 2/239 |
| 2010/0107702 | A1 * | 5/2010 | Rad | 66/178 R |
| 2010/0212072 | A1 * | 8/2010 | Miyasaka | 2/409 |
| 2012/0023646 | A1 * | 2/2012 | Maxey et al. | 2/407 |
| 2012/0036616 | A1 * | 2/2012 | Miyasaka | 2/239 |

* cited by examiner 102
100
101

102
104
103
101

105

107
120
124

107
120
124
103
103

103
back
waistband
120
107
104
106
front
bird's eye view
124

HYBRID HOSIERY

RELATED APPLICATION DATA

This application claims the benefit of priority of U.S. Provisional Patent Application Ser. No. 61/229,594, filed on Jul. 29, 2009, and titled "Hybrid Hosiery," which is incorporated by reference herein in its entirety.

FIELD OF THE INVENTION

The present invention generally relates to the field of hosiery. In particular, the present invention is directed to hybrid hosiery.

BACKGROUND

Women (and sometimes men) typically wear hosiery (nylons, tights, leggings) on their legs, usually under a dress or skirt. Reasons people wear hosiery are: for support, to even skin tone and flatter the body, for additional warmth, to cover their legs to be more conservative, as an undergarment, for extra coverage in case her dress/skirt flies up, or simply as a fashion accessory.

Typical hosiery is made largely of spun nylon blended with spandex, sometimes with a cotton-lined crotch. The top of the garment is folded over, creating a waistband at the top of the garment. The waistband is deemed necessary in order to finish the knit nylon, as well as being necessary in order to prevent the garment from slipping down from the waist to the wearer's hips. As those skilled in the art will understand, a variety of other yarns are used or blended to make the legs.

Traditionally, whether hosiery is control top or designed for comfort, the waistband digs into the wearer's body. The digging effect is uncomfortable for the wearer, as her body is constricted. The discomfort is further exacerbated when the wearer is seated and/or after a full day dressed in traditional hosiery. In addition to discomfort, traditional waistbands are inadequate because they create an undesirable look where the woman's body bulges over the top of the narrow, constricting waistband.

SUMMARY

In one implementation, the present disclosure is directed to a hosiery that includes: a legwear portion made of a first stretchable material, the legwear portion having an upper end; and a waistband having a raw-cut upper edge and a raw-cut lower edge, the raw-cut lower edge secured to the legwear portion at the upper end of the legwear portion with a smooth seam, the waistband being made of a second stretchable material that does not roll and does not fray at the raw-cut upper edge.

In another implementation, the present disclosure is directed to a hosiery that includes: a legwear portion made of a first stretchable material having a denier in a range from about 3 to about 100, the legwear portion having an upper end located at about the hips of an intended wearer when the hosiery is worn by the intended wearer; and a waistband having a raw-cut upper edge and a raw-cut lower edge, the raw-cut lower edge secured to the legwear portion at the upper end with a smooth seam, the waistband being made of a second stretchable material that does not roll and does not fray at the raw-cut upper edge, wherein the raw-cut upper edge of the waistband is located at about the waist of the intended wearer when the intended wearer is wearing the hosiery.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities show in the drawings, wherein.

DETAILED DESCRIPTION

Hybrid hosiery made in accordance with concepts disclosed herein is unique because the construction of the garment incorporates a special waistband made of a special nylon/spandex blend fabric that does not curl or fray when cut and does not require a finish, such as hem or attached elastic or trim. The hybrid hosiery waistband is raw cut, leaving the top of the garment with a completely unfinished edge. The raw-cut edges provide an aesthetically pleasing look that looks clean and lays flat. Additionally, the raw-cut edges provide comfort because they do not dig into the wearer's waist. In one embodiment, the hybrid hosiery includes knit legwear that is secured to the raw-cut waistband using an overlock stitch seam. The unique fabric of the waistband is constructed in such a manner that creates the precise amount of friction that is required in order to keep the garment in the proper location on the wearer's body. The exact sizing and proportions of hybrid hosiery prevent the garment from slipping from the wearer's waist down to her hips or lower. Furthermore, the special properties of the waistband's fabric allow the unfinished edge without any rolling effect. Typically, an unfinished seam would curl outward, especially as the wearer moved and changed body positions, and the garment would roll down her body.

Figures 1A, 1B, 1C, 2, 3A, 3B, 3C:
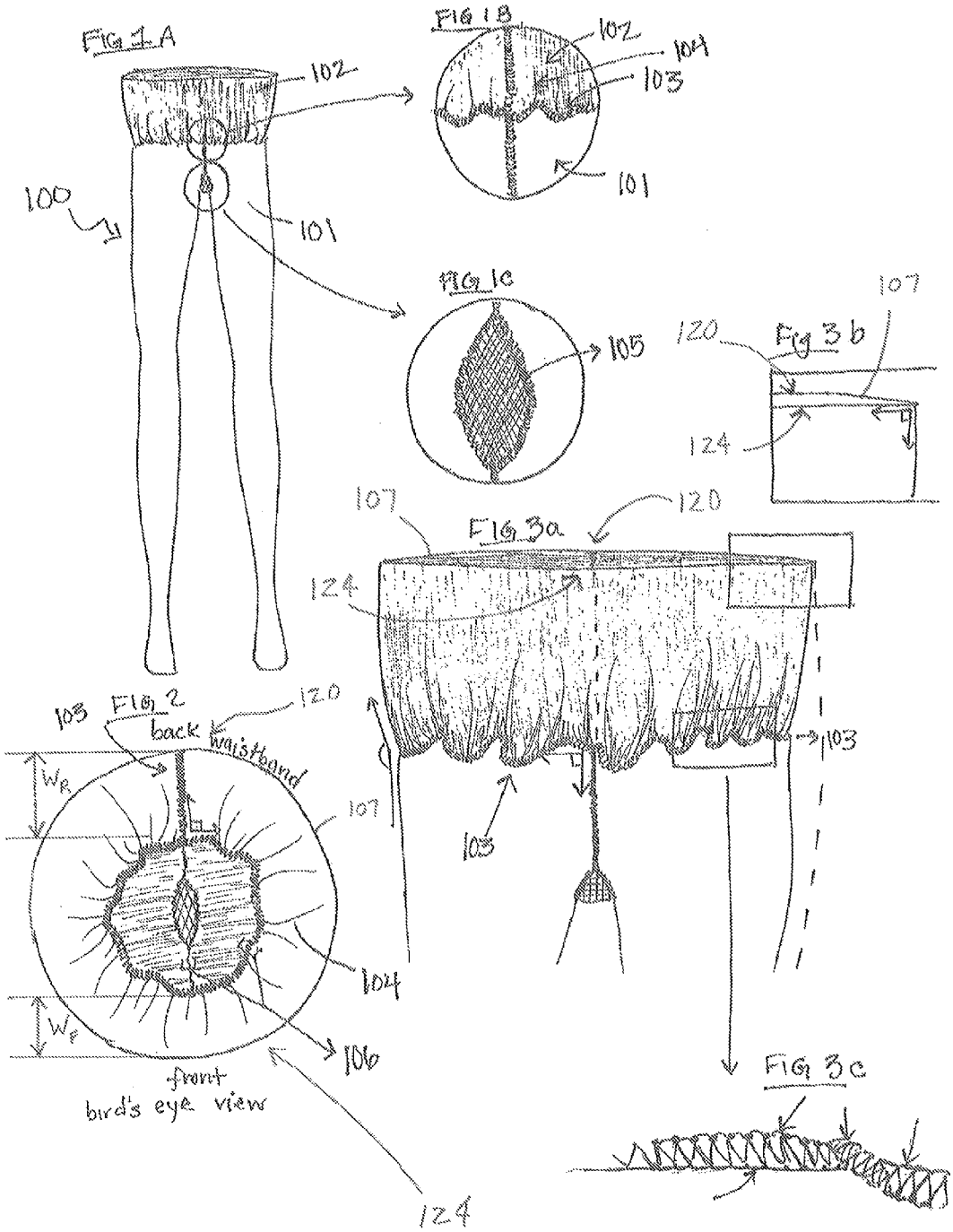
FIG. 1A is an elevational front view of an example of hybrid hosiery made in accordance with the present invention.
FIG. 1B is an enlarged partial front view of the example of FIG. 1A showing the detail of the front center seam connection between the waistband and legwear.
FIG. 1C is an enlarged partial bottom view of the example of FIG. 1A showing the cotton-lined gusset.
FIG. 2 is an enlarged overhead view of the inside of the example of FIG. 1A, showing locations of various seams.
FIG. 3A is an enlarged partial elevational front view of the example of FIG. 1A showing the raw edge (no elastic) of the waistband.
FIG. 3B is a further enlarged partial elevational front view of the intersection of a side of the hybrid hosiery at the waistband and the unfinished upper edge of the waistband, as taken from FIG. 3A.
FIG. 3C is a further enlarged partial perspective view highlighting the overlock seam, as taken from FIG. 3A.

Referring now to the drawings, FIGS. 1A-B illustrate an example of hybrid hosiery 100 that combines a knit legwear portion 101 with a raw-cut nylon-spandex microfiber waistband 102. In one example, waistband 102 is made of a 72% nylon/28% spandex blend. As those skilled in the art will appreciate, nylon-spandex material having other relative blends are available and could be used in place of the noted 72% nylon/28% spandex blend. In addition, such blends may include other material(s) in various amounts. In this example, waistband portion 102 is secured to the legwear portion 101 so as to create an invisible, non-constricting garment, and the legwear portion is made of a conventional tubular knit pantyhose material, such as a nylon-based material having a denier ranging from about 3 to about 100.

Nylon/spandex waistband 102 is secured to knit legwear portion 101 at a seam, for example, a 4-thread overlock stitch seam 103 that has been graded. Using stretchy thread that allows for additional movement, stitches are the proper distance from each other to ensure comfort, flexibility and stretchability that complements the stretchability of waistband 102 and knit legwear portion 101. Nylon/spandex waistband 102 is sewn with certain pleating 104 that further increases the comfort for the person wearing the garment. Hybrid hosiery 100 is sized so that pleating 104 flattens smoothly and disappears against the body when a person wears the garment, therefore increasing the invisibility of the hosiery. Graded seam 103 allows the two different materials to join smoothly. In this example, hybrid hosiery 100 is provided with a gusset 105 lined with cotton so as to allow the garment to be worn as an undergarment without supplemental intimate apparel.

Waistband 102 has an upper edge that is raw cut and remains so when hybrid hosiery 100 is completed and ready for use. Since the raw cut waistband 102 can be created in a traditional cut and sew process and legwear portion 101 will typically be constructed in a tapered tube shape in a circular knit process, other unique advantages can be brought to bear from variable width waistbands, such as having a waistband higher in the back than in the front, or vice versa. To finish traditional hosiery, manufacturers will (a) fold over the top of the "tube" to form, for example, a 1-inch "self" waistband or (b) sew on a separate elastic strip to function as a waistband. In both cases the waistband is a uniform width. Hybrid hosiery 100, which utilizes a separate fabric sheet that can be cut to exact shape specifications to form waistband 102, affords the ability to, for example, taper the waistband to be 4.5 inches (11.43 cm) high in the front and 5.5 inches (13.97 cm) high in the back when the hosiery is worn, as measured from waistband seam 103. Such a waistband width differential, in this case resulting in a front/back height differential, can improve the appearance, function and fit of the finished garment in a way that traditional approaches cannot. For example, in conventional hosiery made using typical tube-construction techniques, the waistband can ride lower on the wearer in the rear than in the front as the hosiery is stressed and strained in its seat portion to accommodate the buttocks of the wearer. When it occurs, this unevenness of a conventional waistband can be uncomfortable to the wearer, especially when the finished upper is tight on the wearer. In another example, when the material of waistband 102 is relatively less stretchable than the material of legwear portion 101, providing the waistband with a greater width in the rear provides more waistband material to accommodate the greater stretching caused by the wearer's buttocks. In other words, the extra material in waistband 102 at the rear of hosiery 100 compensates for its lower stretchability, thus providing greater comfort to the wearer.

Figure 4:
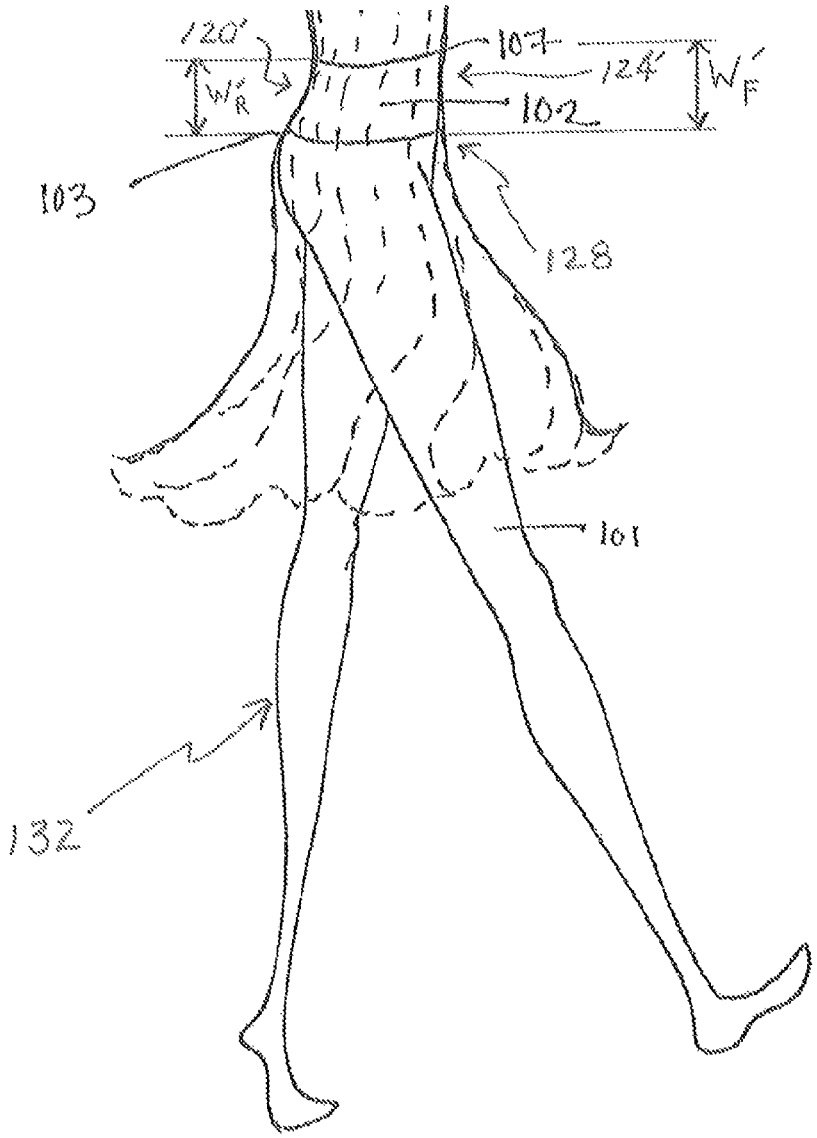
FIG. 4 is a side-elevational partial view of a person wearing the hybrid hosiery of FIG. 1A, demonstrating a practical use of the hosiery in everyday wear under a skirt.

FIG. 2 illustrates an example of the tapering of waistband 102 mentioned above and in which the waistband tapers in width from the rear 120 to front 124 of hybrid hosiery 100. As seen in FIG. 2, which can be taken to scale, the width, $W_R$, of waistband 102 at rear 120 is greater than the width, $W_F$, of the waistband at front 124. In one example, noted above, width $W_R$ is 5.5 inches (13.97 cm) and width $W_F$ is 4.5 inches (11.43 cm). FIGS. 1A, 3A, and 3B also attempt to show the width differential of waistband 102 as between front 124 and rear 120 by raw edge 107 at the rear being shown higher than the raw edge at the front. It is also mentioned above that waistband 102 can be wider at front 124 than at rear 120. This situation is depicted in FIG. 4, wherein front width $W_F'$ is shown as being greater than rear width $W_R'$ by virtue of raw edge 107 being higher at front 124' (i.e., at the lower abdominal region 128 of the wearer 132) than at rear 120'.

Seam 106 (FIG. 2) on legwear portion 101 is tighter than waistband seam 103, thereby increasing the strength and flexibility of the garment. All seams, here, seams 103, 106, align in such a manner so as to lay smooth against a wearer's body. Pleating 104 of waistband 102 is increased when the garment is not on a body, allowing comfort when putting on the garment. Overlock seam 103 is sewn in a manner that allows the garment to stretch to fit.

Depending on the length of the wearer's skirt or dress, legwear portion 101 is usually visible. Waistband 102, however, is not seen, as it is worn as an undergarment. As demonstrated by FIG. 4, hybrid hosiery 100 is flexible, allowing the wearer a wide range of movement. The raw edge 107 of waistband 102 lays completely flat against the wearer's body without digging into the body or creating a visible line. Additionally, seam 103 between legwear portion 101 and waistband 102 is stretchy, smooth, and invisible.

Exemplary embodiments have been disclosed above and illustrated in the accompanying drawings. It will be understood by those skilled in the art that various changes, omissions and additions may be made to that which is specifically disclosed herein without departing from the spirit and scope of the present invention

What is claimed is:

1. A hosiery for being worn by a wearer having a left leg, a right leg, hips, a lower abdominal region, and a waist, the hosiery comprising:

a legwear portion made of a first stretchable material, said legwear portion including:

an upper portion having an upper end located at about the hips of the wearer when the wearer is wearing the hosiery, said legwear portion designed and configured so that said legwear portion has:

a front located proximate the lower abdominal region of the wearer when the wearer is wearing the hosiery; and a rear located opposite said front when the wearer is wearing the hosiery;

a left-leg portion connected to said upper portion and designed and configured to be worn on the left leg of the wearer; and a right-leg portion connected to said upper portion and designed and configured to be worn on the right leg of the wearer; and a waistband having a raw-cut upper edge and a raw-cut lower edge, said raw-cut lower edge secured to said legwear portion at said upper end of said legwear portion with a smooth seam, said waistband being made of a second stretchable material that does not roll and does not fray at said raw-cut upper edge, wherein:

said waistband has a width between said raw-cut upper and lower edges that tapers between said front and back; and said raw-cut upper edge remains unfinished when the hosiery is completed.

2. The hosiery according to claim 1, wherein said waistband has a first width between said raw-cut upper and lower edges at said front of said legwear portion and a second width between said raw-cut upper and lower edges at said rear of said legwear portion, wherein said second width is greater than said first width.

3. The hosiery according to claim 1, wherein said waistband has a minimum width between said raw-cut upper and lower edges that is greater than about 4 inches (10.16 cm).

4. The hosiery according to claim 1, wherein said first stretchable material has a denier from about 3 to about 100.

5. The hosiery according to claim 1, wherein said second stretchable material comprises a nylon-spandex blend.

6. The hosiery according to claim 1, wherein said legwear portion is a product of a circular knitting process.

7. A hosiery for being worn by a wearer having a left leg, a right leg, hips, a lower abdominal region, and a waist, the hosiery comprising:

a legwear portion made of a first stretchable material having a denier in a range from about 3 to about 100, said legwear portion having an upper end located at about the hips of the wearer when the hosiery is worn by the wearer, said legwear portion designed and configured so that said legwear portion has:

a front located proximate the lower abdominal region of the wearer when the wearer is wearing the hosiery; and a rear located opposite said front when the wearer is wearing the hosiery;

a left-leg portion connected to said upper portion and designed and configured to be worn on the left leg of the wearer; and a right-leg portion connected to said upper portion and designed and configured to be worn on the right leg of the wearer; and a waistband having a raw-cut upper edge and a raw-cut lower edge, said raw-cut lower edge secured to said legwear portion at said upper end with a smooth seam, said waistband being made of a second stretchable material that does not roll and does not fray at said raw-cut upper edge, wherein said raw-cut upper edge of the waistband is located at about the waist of the intended wearer when the intended wearer is wearing the hosiery, wherein:

said waistband has a width between said raw-cut upper and lower edges that tapers between said front and back; and said raw-cut upper edge remains unfinished when the hosiery is completed.

8. The hosiery according to claim 7, wherein said second stretchable material comprises a nylon-spandex blend.

9. The hosiery according to claim 8, wherein said legwear portion is a product of a circular knitting process.

10. The hosiery according to claim 7, wherein said waistband has a minimum width between said raw-cut upper and lower edges that is greater than about 4 inches (10.16 cm).

11. The hosiery according to claim 7, wherein said waistband has a first width between said raw-cut upper and lower edges at said front of said legwear portion and a second width between said raw-cut upper and lower edges at said rear of said legwear portion, wherein said second width is greater than said first width.

* * * * *